US010697626B1

(12) United States Patent
Owens et al.

(10) Patent No.: US 10,697,626 B1
(45) Date of Patent: Jun. 30, 2020

(54) LED LUMINAIRE HEATSINK ASSEMBLY

(71) Applicant: SIGNIFY HOLDING B.V., Eindhoven (NL)

(72) Inventors: Walten Peter Owens, Chittenango, NY (US); Benjamin David Vollmer, Manlius, NY (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/251,592

(22) Filed: Jan. 18, 2019

(51) Int. Cl.

| | |
|---|---|
| ***F21V 29/74*** | (2015.01) |
| ***F21S 2/00*** | (2016.01) |
| ***F21V 29/89*** | (2015.01) |
| ***F21V 15/01*** | (2006.01) |
| ***F21Y 115/10*** | (2016.01) |

(52) U.S. Cl.
CPC ..... *F21V 29/74* (2015.01); *F21S 2/005* (2013.01); *F21V 15/01* (2013.01); *F21V 29/89* (2015.01); *F21Y 2115/10* (2016.08)

(58) Field of Classification Search
CPC ..... F21V 29/74; F21V 29/89; F21V 15/01; F21S 2/005
USPC ..... 362/294
See application file for complete search history.

(56) References Cited

U.S. PATENT DOCUMENTS

| | | | | |
|---|---|---|---|---|
| 8,007,127 | B2 * | 8/2011 | Kim | F21V 5/04 362/218 |
| 8,911,106 | B2 * | 12/2014 | Sato | F21S 8/061 362/241 |
| D733,352 | S | 6/2015 | Casper et al. | |
| 9,163,820 | B2 * | 10/2015 | Bakk | F21V 29/004 |
| 9,657,930 | B2 | 5/2017 | Nolan et al. | |
| D792,626 | S | 7/2017 | Casper et al. | |
| 9,730,302 | B2 * | 8/2017 | Vollmer | H05B 37/0254 |
| 9,736,904 | B2 * | 8/2017 | Casper | G09G 3/3413 |
| 9,857,066 | B2 | 1/2018 | Owens et al. | |
| 9,888,545 | B2 | 2/2018 | Casper et al. | |
| 10,036,534 | B2 * | 7/2018 | Morello | F21V 13/02 |
| 10,161,619 | B2 | 12/2018 | Casper et al. | |
| 10,371,345 | B2 * | 8/2019 | Nolan | F21V 3/00 |
| 2010/0053963 | A1 * | 3/2010 | Yang | F21K 9/00 362/249.02 |
| 2011/0261567 | A1 * | 10/2011 | Lee | F21S 8/086 362/249.03 |

(Continued)

*Primary Examiner* — Bryon T Gyllstrom

(57) ABSTRACT

A heatsink assembly for a luminaire may include a shell portion and one or more lighting module holders. The shell portion may include a frame and one or more cross members that may be attached to the inner surface of the frame and that may form one or more openings proximate to the rear end of the frame. The frame may be made of a material that has a lower thermal conductivity than that of the material of the one or more lighting module holders. The one or more lighting module holders may be configured to be held in the one or more openings. The one or more lighting module holders may contain a landing pad and a plurality of inner fins that are connected to the lower surface and positioned to extend from the corresponding opening. The landing pad may have an upper surface that is configured to receive a lighting module and a lower surface that is sized to correspond to and be larger than a corresponding one of the openings. In some embodiments, the lighting module holder forms a heat sink.

21 Claims, 4 Drawing Sheets

(56) References Cited

U.S. PATENT DOCUMENTS

| | | | | |
|---|---|---|---|---|
| 2013/0155688 | A1* | 6/2013 | LaVigna | F21V 21/00 362/311.01 |
| 2014/0199168 | A1* | 7/2014 | Spiro | F04D 29/582 416/5 |
| 2015/0167937 | A1* | 6/2015 | Casper | F21V 23/02 362/294 |
| 2016/0047538 | A1* | 2/2016 | Peck | F21S 2/005 362/249.02 |

* cited by examiner

LED LUMINAIRE HEATSINK ASSEMBLY

BACKGROUND

Many entertainment, commercial, and industrial facilities use light emitting diode (LED) based luminaires for lighting. The LED based luminaires provide these facilities with the ability to achieve smart control of high quality light, reliable light output, adjustable shape and intensity of the light, and improved energy efficiency. Although the LEDs used in the LED based luminaires are more energy efficient than other lighting devices such as incandescent lighting, LEDs also give off heat. A portion of the electricity provided to the LEDs of the luminaire is converted to heat that is internal to the LED. It is essential to remove this heat through efficient thermal management to ensure the LED characteristics remain unchanged. More specifically, the heat produced by an LED affects the junction temperature of the LED which directly affects the lifetime of the LED. Therefore, developing an efficient way to move heat away from the LED is desired.

This document describes a heatsink assembly that is directed to solving the issue described above, and/or other issues.

SUMMARY

In an embodiment, a heatsink assembly for a luminaire may include a shell portion and one or more lighting module holders. The shell portion may include a frame and one or more cross members. The frame has an outer surface and an inner surface, and a front end and a rear end. The one or more cross members are attached to the inner surface of the frame and form one or more openings proximate to the rear end of the frame. Each lighting module holder is configured to be held in one of the openings. Each lighting module holder may include a landing pad and a plurality of inner fins that are connected to the lower surface and positioned to extend from the corresponding opening and past the rear end of the frame. The landing pad may have an upper surface that is configured to face the front end of the frame and receive a lighting module and a lower surface that is opposite the upper surface and that is sized to correspond to and be larger than a corresponding one of the openings.

The frame may include a plurality of outer fins that are attached to the outer surface and that extend from the front end of the frame toward the rear end of the frame. The outer fins of the frame may extend to an ending position that is beyond the rear end of the frame. The frame can be many different shapes, for example, the frame may be annular and/or it may have an inner surface that is angled so that a circumference of the frame at the rear end is smaller than a circumference of the frame at the front end. The frame may contain an area formed by the inner surface between the front end and rear end that forms a bowl that is configured to receive a plurality of LED modules. The material of the frame can be metal, such as aluminum alloy.

The material of each lighting module holder can be metal, such as aluminum. The material of each lighting module holder may have a higher thermal conductivity than the material of the frame. Each lighting module holder may have a gasket that is configured to provide a seal between the landing pad and the corresponding opening of the shell portion.

In some embodiments, the shell portion of the heatsink may be formed by die casting and the one or more lighting module holders of the heatsink may be formed by cold forging or extrusion. The shell portion that is die casted can include the plurality of outer fins that are attached to the outer surface of the frame and that extend from the front end of the frame toward the rear end of the frame.

In various embodiments, the heatsink is provided by at least the one or more lighting module holders. The heatsink can also include the outer fins attached to the outer surface of the frame, the one or more cross members, and the frame. The heatsink may be configured to draw heat away from the lighting modules and past the rear end of the frame when the lighting modules are energized.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" (or "comprises") means "including (or includes), but not limited to."

In this document, when terms such as "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

When used in this document, terms such as "upper" and "lower" or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

Figure 1:
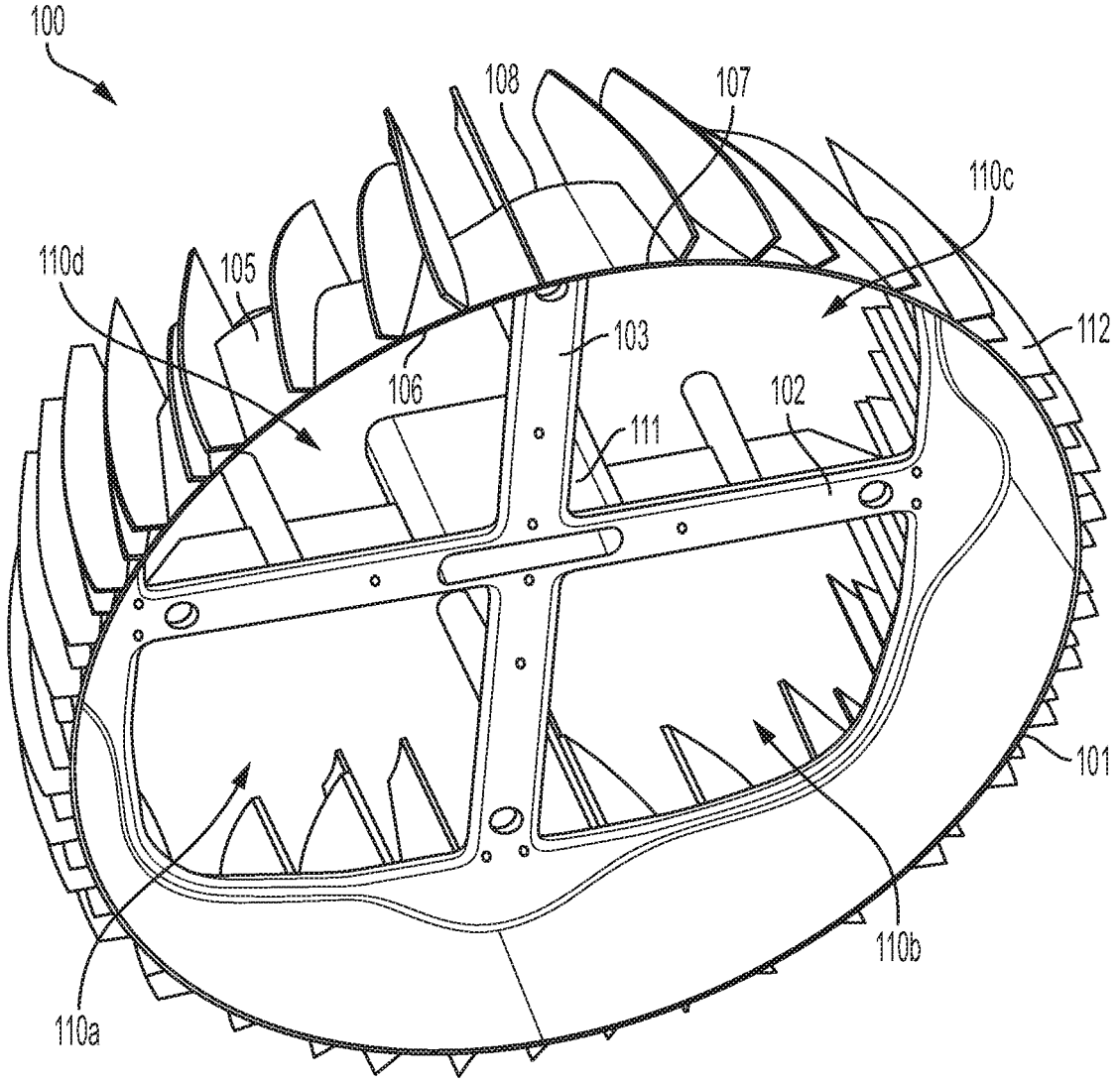
FIG. 1 illustrates a front view of a shell portion of the heat sink assembly for some embodiments.

FIG. 1 illustrates that the heatsink assembly for a luminaire may include a shell portion 100. As shown in FIG. 1, the shell portion 100 includes a frame 101 and one or more cross members 102, 103. As shown in FIG. 1, the frame 101 has an outer surface 105 and inner surface 106, and a front end 107 and a rear end 108. The one or more cross members 102, 103 are attached to the inner surface 106 of the frame and form one or more openings 110*a*-110*d* proximate to the rear end 108 of the frame 101. For example, in one embodiment, the shell portion 100 contains two cross members 102, 103 that form four openings 110*a*-110*d*, such as shown in FIG. 1.

In some embodiments, the one or more cross members can have an extendable portion 111 that extends from the surface facing the rear end of the frame, such as shown in FIG. 1. The extendable portion 111 may be of any shape, size, or parts. In some embodiments, the portion of the cross member extending from the surface facing the rear end of the frame contains a plurality of fins. Additionally, as shown in FIG. 1, the one or more cross members 102, 103 can contain holes on the surface facing the front end 107 of the frame 101. These holes can be used to mount lighting modules to the one or more cross members 102, 103 via screws, a ring clamp, or any method to establish a secure connection.

Figure 2:
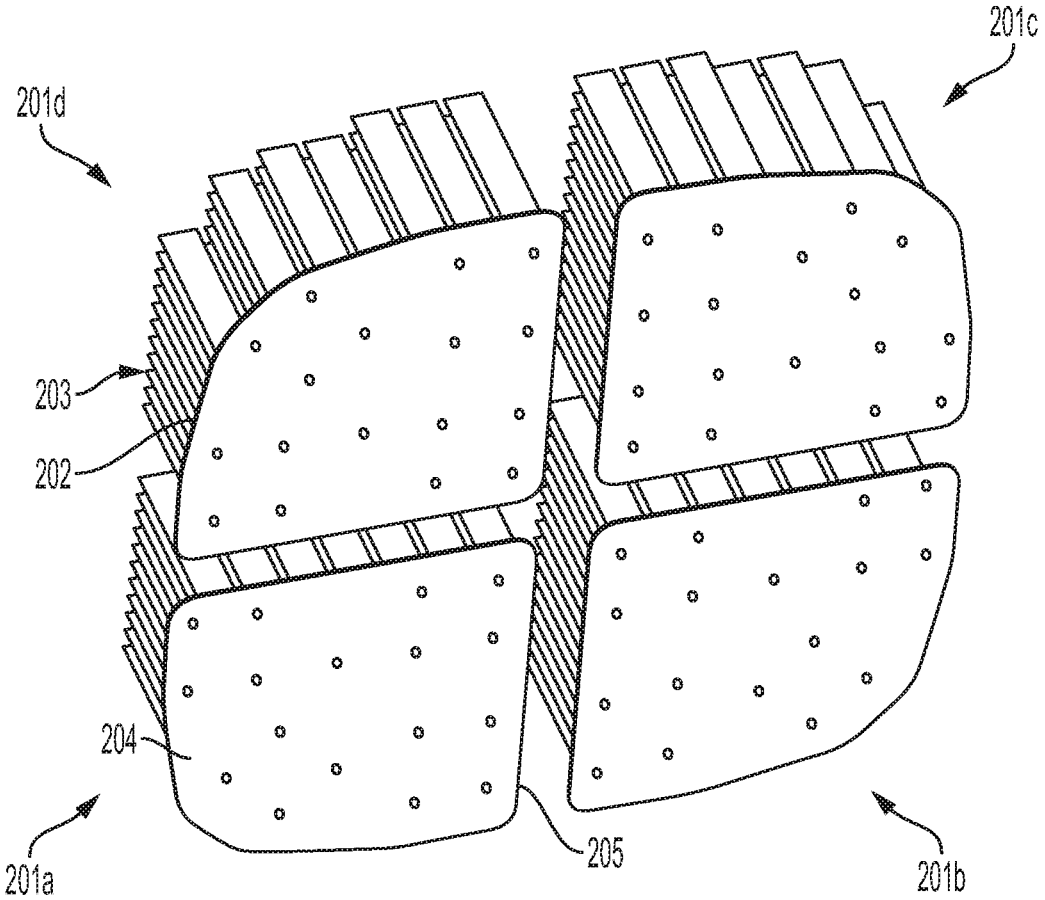
FIG. 2 illustrates a front view of the lighting module holders for some embodiments.

FIG. 2 shows that the heatsink assembly may include one or more lighting module holders 201*a*-201*d*. The lighting module holders 201*a*-201*d* are configured to be held in the corresponding openings 110*a*-110*d* of the shell portion. In one embodiment, such as shown in FIG. 2, the four lighting module holders 201*a*-201*d* are configured to be held in the four corresponding openings 110*a*-110*d* of the shell portion 100. In some embodiments, the lighting module holders are held in the opening of the shell portion by screws or a press fit.

As shown in FIG. 2, each lighting module holder 201*a*-201*d* contains a landing pad 202 and a plurality of inner fins 203. The landing pad shown in FIG. 2, has an upper surface 204 that is configured to face the front end 107 of the frame 101 and receive a lighting module, and a lower surface 205 that is opposite the upper surface 204 and that is sized to correspond to and be larger than the corresponding openings 110*a*-110*d* of the shell portion 100. As shown in FIG. 2, the upper surface of the landing pad can contain holes that allow the lighting module to be connected to the landing pad via screws, a ring clamp, or any method to establish a secure connection. As shown in FIG. 2, a plurality of inner fins 203 are connected to the lower surface of the landing pad and positioned to extend from the corresponding opening of the shell portion 100 and past the rear end 108 of the frame 101. Although FIG. 2 shows that each fin is equal in dimension to an adjacent fin, the fins are not required to have the same dimensions.

In operation, the lighting module holder forms the heat sink by drawing heat away from the lighting modules and past the rear end of the frame when the lighting modules are energized. Optionally, a plurality of outer fins 112 may be attached to the outer surface of the frame, where the outer fins extend from a front end of the frame toward a rear end of the frame, as shown in FIG. 1. In this embodiment, when the lighting module holder is held in the corresponding opening of the shell portion, the lighting module holder is thermally connected to the shell portion, and a heatsink is formed by the lighting module holder, the frame, the outer fins of the frame, and the one or more cross members. The heat can be removed from the heatsink assembly and dissipated via the fins by a liquid coolant or air, such as forced air.

Although FIG. 1 shows a plurality of outer fins 112 that are attached to the outer surface of the frame and that extend from the front end of the frame toward the rear end of the frame, it is not a requirement for the plurality of outer fins 112 to extend to an ending position that is beyond the rear end of the frame. The plurality of outer fins 112 may be of any length. Additionally, the frame of the shell portion can be many different shapes, for example, the frame may be annular and/or it may have an inner surface that is angled so that a circumference of the frame at the rear end is smaller than a circumference of the frame at the front end. Additionally, the frame may contain an area formed by the inner surface between the front end and rear end of the frame that forms a bowl that is configured to receive a plurality of LED modules.

The components shown in the figures can all be made of the same material or different components can be made of different material. Some examples of the material that can be used are plastic, thermally conductive plastic, or metal. For example, in some embodiments, the frame can comprise a first material, such as aluminum alloy, having a first level of thermal conductivity of approximately 100 W/mK. In the same embodiments, the one or more lighting module holders can comprise a second material, such as aluminum, having a second level of thermal conductivity of approximately 215 W/mK. In these embodiments, the thermal conductivity of the second material is higher than the thermal conductivity of the material of the frame. Therefore, when the embodiment includes a plurality of outer fins attached to the outer surface of the frame, the frame removes heat away from the LED modules, however, the lighting module holder removes more heat away from the LED modules.

Figure 3:
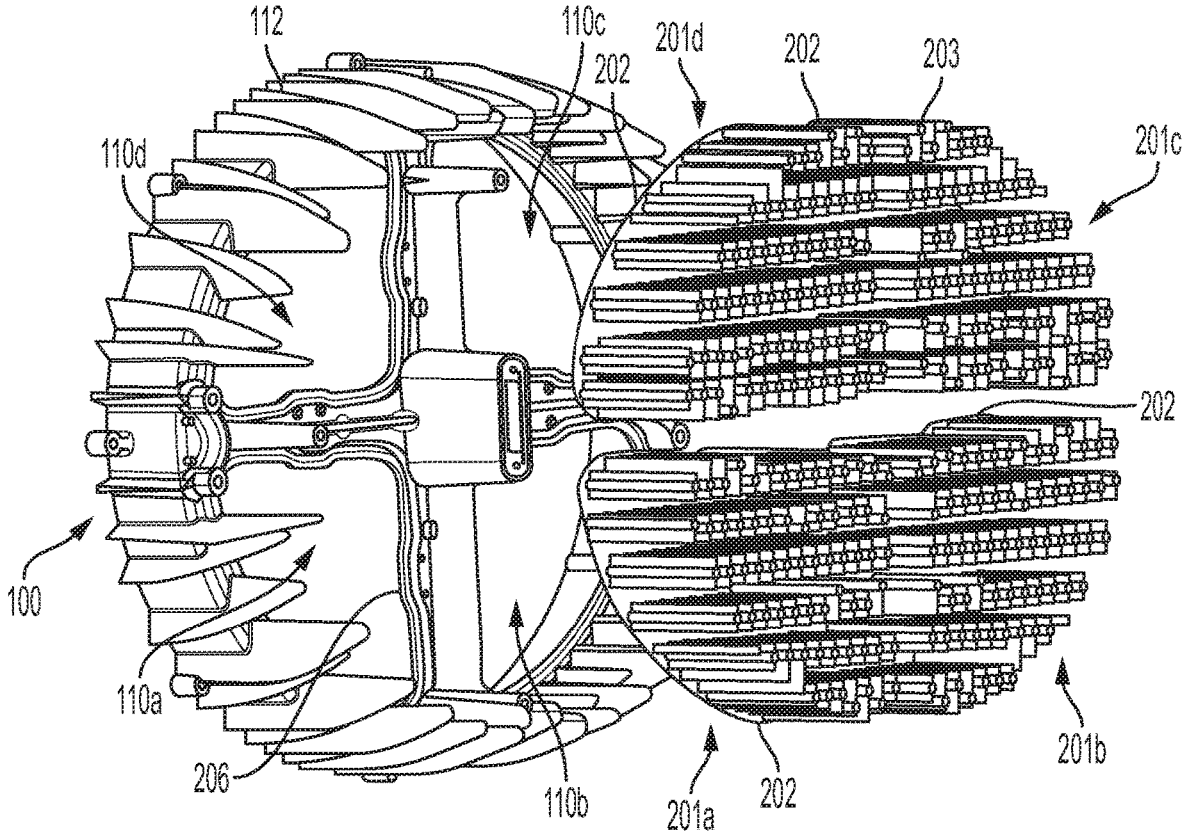
FIG. 3 illustrates a rear view of a shell portion of the heat sink assembly and a rear view of the lighting module holders for some embodiments.

FIG. 3 shows a rear view of a shell portion 100 of the heat sink assembly and a rear view of the lighting module holders 201*a*-201*d* for some embodiments. In some embodiments, each lighting module holder 201*a*-201*d* may have a gasket 206 that is configured to provide a seal between the landing pad 202 and the corresponding openings 110*a*-110*d* of the shell portion, as shown in FIG. 3. FIG. 3 also shows a plurality of inner fins 203 connected to the lower surface of the landing pad 202 and a plurality of outer fins 112 attached to the outer surface of the frame. In this embodiment, the gasket 206 that provides the seal is between the corresponding openings 110*a*-110*d* of the shell portion and the upper surface of the landing pad 202, which is the surface of the landing pad 202 (which is pointing to the surface not visible in FIG. 3) that is opposite the surface containing the plurality of inner fins 203. The seal can be used to create a waterproof bond between the shell portion and the one or more lighting module holders. The seal can be a ring, liquid seal, or any other object that can create a seal. If heat is dissipated via the fins by a liquid coolant, the seal can protect the electronics from the liquid coolant.

Figure 4:
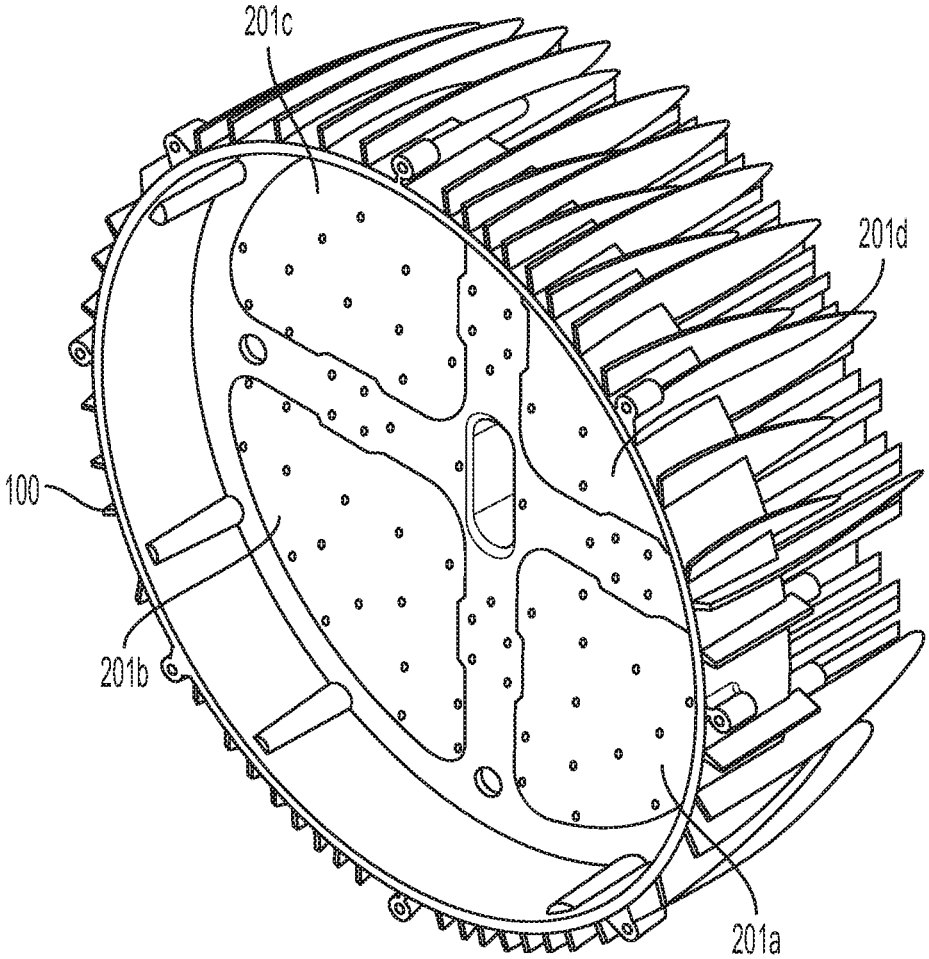
FIG. 4 illustrates an example heat sink assembly with the lighting module holders installed in the shell portion.

FIG. 4 shows the example shell portion 100 of the heat sink assembly with the lighting module holders 201*a*-201*d* installed in the shell portion 100. The lighting modules will connect to the landing pad of the lighting module holders and the lighting module holders and the shell form a heatsink assembly.

In some embodiments, one or more of the components shown in the figures for a heatsink assembly for a LED luminaire may be formed by die casting. Die casting is a metal casting that is characterized by forcing molten metal under high pressure into a mold cavity. After the casting solidifies, it is then removed from the dies. For some embodiments, the shell portion is formed by die casting a material. In these embodiments, the shell portion can include the frame, one or more cross members, and the extendable portion of the one or more cross members. The shell portion can also include the plurality of outer fins that are attached to the outer surface of the frame and that extend from the front end of the frame toward the rear end of the frame. A die casting method allows flexibility in the shape of the mold. For example, using a die casting method, the frame of the shell can have a geometric shape, such as annular, rectangular, triangular, etc or any organic shape. For some embodiments, the shell can be a geometric shape containing an annular frame that contains one or more cross members and a plurality of outer fins that are attached to the outer surface of the frame.

In some embodiments, one or more of the components shown in the figures for a heatsink assembly for a LED luminaire may be formed by cold forging. Cold forging is a metal shaping process by application of compressive force while the metal is below its recrystallization point. Recrystallization of a metal occurs when the metal is heated whereby deformed grains are replaced by a new set of grains that nucleate and grow until the original grains have been entirely consumed. The method of cold forging typically occurs at or near room temperature, and it does not require the metal to be heated. One benefit of cold forging is that it can produce very thin and tall shapes of metal that can be an integral part of the base structure with no air gaps. In some embodiments, the lighting module holders may be formed by cold forging. For these embodiments, the lighting module holder includes a landing pad and a plurality of inner fins. The method of cold forging, would result in thin, tall fins as shown in FIG. 2, to be used as the plurality of inner fins that are connected to the lower surface of the one or more lighting module holders. Tall, thin fins will remove the heat further away from the lighting module holders forming a more efficient heatsink.

In some embodiments, one or more of the components shown in the figures for a heatsink assembly for a LED luminaire may be formed by extrusion. Extrusion is a method where a metal is passed through a die of the desired cross section. Through compressive and shear stresses, this method gives the ability to create very complex cross-sections. In some embodiments, the shell portion of the heatsink can be comprised of an aluminum die casting alloy. Although aluminum and aluminum alloys are metals that have a high thermal conductivity, any other metal can be used for the heatsink or a portion of the heat sink. Some other metals that can be used for the heatsink are copper, brass, steel, bronze, etc. The intent is that the heatsink discussed herein can be formed with any metal of preference.

The above paragraphs detail die casting, cold forging, and extrusion. The intent is that any one of these three methods, or any other suitable method, can be used to form the entire heatsink or any part of the heatsink. Additionally, in some embodiments, one or more parts of the heatsink can be formed using more than one method. For example, in one embodiment, the shell portion of the heatsink may contain a frame that is formed by a method of die casting and one or more cross members that are formed by a method of extrusion. The discussion herein applies to any combination of methods used to form any part of the heatsink.

The features and functions described above, as well as alternatives, may be combined into many other different systems or applications. Various alternatives, modifications, variations or improvements may be made by those skilled in the art, each of which is also intended to be encompassed by the disclosed embodiments.

The invention claimed is:

1. A heatsink assembly for a luminaire, the heatsink assembly comprising:

a shell portion comprising:

a frame comprising an outer surface and an inner surface, and a front end and a rear end, wherein the frame comprises a first material having a first level of thermal conductivity, and one or more cross members that are attached to the inner surface of the frame and that form one or more openings proximate to the rear end of the frame; and one or more lighting module holders, each of which is configured to be held in one of the openings, each of which comprises a second material having a second level of thermal conductivity that is higher than the first level of conductivity, and each of which comprises:

a landing pad having an upper surface that is configured to face the front end of the frame and receive a lighting module, and a lower surface that is opposite the upper surface and that is sized to correspond to and be larger than a corresponding one of the openings, and a plurality of inner fins that are connected to the lower surface and positioned to extend from the corresponding opening and past the rear end of the frame;

wherein the lighting module holder forms a heat sink.

2. The heatsink assembly of claim 1, wherein the heat sink is configured to draw heat away from the lighting modules and past the rear end of the frame when the lighting modules are energized.

3. The heatsink assembly of claim 1, further comprising:

a plurality of outer fins that are attached to the outer surface of the frame and that extend from a front end of the frame toward a rear end of the frame, and wherein the heat sink also comprises the outer fins, the one or more cross members, and the frame.

4. The heatsink assembly of claim 3, wherein the outer fins extend to an ending position that is beyond the rear end of the frame.

5. The heatsink assembly of claim 1, wherein an area of the frame formed by the inner surface between the front and the rear end forms a bowl that is configured to receive the LED modules.

6. The heatsink assembly of claim 1, wherein the inner surface is angled so that a circumference of the frame at the rear end is smaller than a circumference of the frame at the front end.

7. The heatsink assembly of claim 1, wherein the frame is annular.

8. The heatsink assembly of claim 1, wherein the first material comprises an aluminum die casting alloy, and the second material comprises aluminum.

9. The heatsink assembly of claim 1, further comprising, for each of the lighting module holders, a gasket that is configured to provide a seal between the landing pad and the corresponding opening of the shell portion.

10. A light emitting diode (LED) luminaire, comprising:

a plurality of LED modules; and a heatsink assembly comprising:

a shell portion comprising:

a frame comprising an outer surface and an inner surface, and a front end and a rear end, wherein the frame comprises a first material having a first level of thermal conductivity; and one or more cross members that are attached to the inner surface of the frame and that form one or more openings proximate to the rear end of the frame, and one or more LED module holders, each of which is configured to be held in one of the openings, each of which comprises a second material having a second level of thermal conductivity that is higher than the first level of conductivity, and each of which comprises:

a landing pad having an upper surface that is configured to face the front end of the frame and receive one or more of the LED modules, and a lower surface that is opposite the upper surface and that is sized to correspond to and be larger than a corresponding one of the openings; and a plurality of inner fins that are connected to the lower surface and positioned to extend from the corresponding opening and past the rear end of the frame, wherein the lighting module holder forms a heat sink.

11. The LED luminaire of claim 10, wherein the heat sink is configured to draw heat away from the lighting modules and past the rear end of the frame when the lighting modules are energized.

12. The LED luminaire of claim 10, further comprising:

a plurality of outer fins that are attached to the outer surface of the frame and that extend from a front end of the frame toward a rear end of the frame, and wherein the heat sink also comprises the outer fins, the one or more cross members, and the frame.

13. The LED luminaire of claim 12, wherein the outer fins extend to an ending position that is beyond the rear end of the frame.

14. The LED luminaire of claim 10, wherein an area of the frame formed by the inner surface between the front and the rear end forms a bowl that is configured to receive the LED modules.

15. The LED luminaire of claim 10, wherein the inner surface is angled so that a circumference of the frame at the rear end is smaller than a circumference of the frame at the front end.

16. The LED luminaire of claim 10, wherein the frame is annular.

17. The LED luminaire of claim 10, wherein the first material comprises an aluminum die casting alloy, and the second material comprises aluminum.

18. The LED luminaire of claim 10, further comprising, for each of the lighting module holders, a gasket that is configured to provide a seal between the landing pad and the corresponding opening of the shell portion.

19. A method of forming a heatsink assembly for a light emitting diode (LED) luminaire, the method comprising:

forming, by die casting a first material having a first level of thermal conductivity, a shell portion comprising:

a frame comprising an outer surface and an inner surface, and a front end and a rear end, and one or more cross members that are attached to the inner surface of the frame and that form one or more openings proximate to the rear end of the frame; and forming, by cold forging or extruding a second material having a second level of thermal conductivity that is higher than the first level of conductivity, one or more lighting module holders, each of which is configured to be held in one of the openings, and each of which comprises:

a landing pad having an upper surface that is configured to face the front end of the frame and receive a lighting module, and a lower surface that is opposite the upper surface and that is sized to correspond to and be larger than a corresponding one of the openings, and a plurality of inner fins that are connected to the lower surface; and placing each of the lighting module holders over its corresponding opening so that the landing pad of each lighting module holder fits over its corresponding opening, and so that the inner fins of each lighting module holder extends though the corresponding opening and past the rear end of the frame and that provide a heat sink.

20. The method of claim 19, wherein:

forming the shell by die casting also comprises forming a plurality of outer fins that are attached to the outer surface of the frame and that extend from a front end of the frame toward a rear end of the frame, and the heat sink also comprises the outer fins, the one or more cross members, and the frame.

21. The method of claim 19, wherein the first material comprises an aluminum die casting alloy, and the second material comprises aluminum.

* * * * *